United States Patent [19]

Albericci

[11] Patent Number: 4,690,736

[45] Date of Patent: Sep. 1, 1987

[54] CHROMIC ACID ANODIZING OF ALUMINIUM PRIOR TO ADHESIVE BONDING

[75] Inventor: Peter Albericci, Woodford, England

[73] Assignee: British Aerospace Public Limited Company, London, England

[21] Appl. No.: 844,151

[22] Filed: Mar. 26, 1986

[30] Foreign Application Priority Data

Mar. 26, 1985 [GB] United Kingdom ..... 8507761

[51] Int. Cl.[4] ..... C25D 5/00

[52] U.S. Cl. ..... 204/38.3; 204/38.7; 204/42; 204/58; 156/151; 428/469

[58] Field of Search ..... 204/58, 38.3, 0.7, 42; 156/151; 428/469

[56] References Cited

U.S. PATENT DOCUMENTS 4,085,012 4/1978 Marceau et al. ..... 204/38.3

FOREIGN PATENT DOCUMENTS 1127098 9/1968 United Kingdom ..... 204/38.3
1464857 2/1977 United Kingdom ..... 204/58

OTHER PUBLICATIONS

Excerpt from "The Canning Handbook", pp. 810–813.
Defence Specification DEF-151, "Anodizing of Aluminium and Aluminium Alloys", London, Mar. 1965 (Reprinted Mar. 1966).

*Primary Examiner*—R. L. Andrews
*Attorney, Agent, or Firm*—Cushman, Darby & Cushman

[57] ABSTRACT

A method of pre-treating articles of aluminium or aluminum alloy to form an environmentally stable adhesive receptive oxide layer, the method comprising anodizing said articles in a bath containing an aqueous solution of chromic acid at a minimum defined temperature/time/-voltage cycle. By this method a particularly advantageous oxide surface layer is achieved in which the pore diameter of the outer, non-barrier layer is at least a factor of 10 larger than that achieved by prior art processes.

6 Claims, No Drawings

CHROMIC ACID ANODIZING OF ALUMINIUM PRIOR TO ADHESIVE BONDING

This invention relates to the chromic acid anodising of aluminium or its alloys as a pretreatment for a bonding process.

In processes where metal structures are to be formed by adhesively bonding metal parts together, the importance of the prior treatment of the metal surface,—i.e. the pretreatment of the part—has long been recognised. It is accepted that the peel or cleavage strength of the bond and the long term durability depend very largely on the pretreatment of the surface prior to bonding.

In an established practice the aluminium parts are acid-etched (or "pickled") in a solution of chromic acid and sulphuric acid. This treatment gives excellent joint properties at the time of manufacture but the durability of the joint made with usual adhesives (e.g. epoxide resins) can be very poor, particularly when exposed to wet or damp environments.

More recently, the aluminium parts have been anodised using various electrolytes which generate certain characteristic surface features depending on the particular acid and the bath operating conditions. A process using a chromic acid bath and relatively low bath temperatures (30° C. to 40° C.) has been used for a long time and is favoured in the aircraft industry because of the corrosion resistance, relatively high ductility, and the fact that any liquor accidentally trapped in the anodised structure does not lead to subsequent corrosion. This form of chromic acid anodising process was developed to optimise corrosion resistance and features a dense oxide layer about 4 to 5 microns thick and having a small pore size. With regard to adhesive bonding however, the characteristic chromic acid anodised surface achieved by the above process is not well suited, because the oxide layer is too smooth and the cell size of the pores is not scaled to the molecular dimensions of the viscous polymers used in strong adhesives. Consequently an inherent feature of adhesive bonds made between aluminium parts anodised according to the above process is a low peel and cleavage strength which leads to a "fast crack" type of failure.

It is therefore an aim of this invention to provide a chromic acid anodising process which is specifically adapted to create an oxide layer which is highly receptive to adhesives, for example solvent-free high polymer adhesives of the cold curing and heat setting kinds.

According to one aspect of this invention, there is provided a method of pretreating an article of aluminium or aluminium alloy prior to a bonding process, to form an environmentally stable adhesive receptive oxide layer, said method comprising anodising said articles in a bath containing an aqueous solution of chromic acid at a temperature of at least 55° C. for a period of at least 20 minutes at a voltage of at least 5 volts. By this method a particularly advantageous oxide surface layer is achieved in which the pore diameter of the outer, non-barrier layer is at least a factor of 10 larger than that achieved by the prior art processes: the diameter achieved by the method of this invention is typically 0.2 microns.

Preferably, the temperature of said bath lies in the range of from 60° C. to 62° C.

Preferably, the concentration of chromic acid in solution lies in the range of from 3% to 5% W/W.

A discussion now follows of the operating variables in the anodising process of this invention, namely temperature, voltage and process time.

The operating temperature of the chromic acid electrolyte is the most significant variable and requires greater attention and control than the other two factors. In order to attain high peel and high cleavage strengths with a wide range of adhesives it was found necessary to raise the solution temperature to at least 55° C. but preferably to the precise range of 60° C.-62° C. Even higher temperatures may be used but then a notable degree of white "bloom" is formed on the surface and the current density rises to high levels.

The lower temperature limits of 55° C. may be found to give high peel strengths with certain aluminium alloys but when the subject metal is clad aluminium sheet (a standard material in aircraft manufacture) the adopted temperature should be 60° C.-62° C. on account of its universality of action.

Referring now to the anodising voltage, good bonding results may be achieved with as little as 5 volts D.C. anodising potential. However, the conversion thickness is insufficient for overall corrosion protection. At 10 volts an improved balance of corrosion protection and adhesive adsorbtion is obtained using practical and economical cycle times of 30 minutes.

For the most universally receptive surface with respect to alloy types and adhesive forms a step-wise voltage profile is necessary, e.g. 15 mins at 10 volts followed by 15 mins at 20 volts. Alternatively, 10 mins at 10 volts followed by 20 mins at 20 volts may be used to gain some increase in porosity at the expense of abrasion resistance.

Referring now to the operating cycle time, for the consistent production of a surface of the required thickness and type of structure a minimum time of 20 minutes is required. However, clad aluminium sheet of the L164 type featuring high purity face material requires a process time of 30 minutes or more. At this process time (30 minutes) and using the solution strength, temperature, and voltage as set out in the above relevant paragraphs an anodic oxide film thickness of about 3 microns is obtained the characteristic features of which provide a high performance, corrosion resistant, durable, and cost effective treatment for structural adhesive bonding.

Referring now to the metal treatment performed prior to the actual anodising process, the only necessary prior treatment is the removal of oil or grease-like contaminants present on the sheet etc. in the "as received" state. This operation is commonly carried out using a solvent vapour degreasing tank. Alternatively an aqueous alkali scouring bath is sometimes adopted. Both routes are suitable prior stages for the new process and generally one such degreasing operation is the only requirement needed before passing on to the herein described high temperature anodising process itself.

In the special case of long aged or highly heat treated material where the natural oxide layer present is suspected of being unusually thick it has been found beneficial to include the well known chromic/sulphuric acid pickle treatment as a preliminary stage in order to obtain maximum consistency. Mechanical forms of surface conditioning may also be used such as fine grit blasting or "vapour blasting". However, it is stressed that the complications of this intermediate stage are normally quite unnecessary to the process as described.

For a better understanding two specific examples of processes according to this invention will now be described.

In each of the following examples typical procedures are given which can be adopted in order to achieve highly adhesive receptive bonding surface on clad aluminium of type L164 specification.

| | |
|---|---|
| Example 1 (aged bath) | |
| Degrease stage | solvent vapour tank |
| Intermediate stage | chrome/sulphuric pickle |
| Chromic Acid Anodising Process | |
| Bath concentration | free chromic acid 35 g/L<br>total chromic acid 95 g/L |
| Bath temperature | 62° C. |
| Voltage | 10 v |
| Process time | 30 minutes |
| Example 2 (new bath) | |
| Degrease stage | solvent vapour tank |
| Intermediate stage | none |
| High Temperature Chromic Acid Anodising Process | |
| Bath concentration | free chromic acid 35 g/L<br>total chromic acid 40 g/L |
| Bath temperature | 61° C. |
| Voltage | 10 volts for 15 minutes followed by |
| Process time | 20 volts for 15 minutes |

PERFORMANCE COMPARISON

Shear Strength and Peel Strength

The perfomance of an adhesive joint is generally quantified by reference to its overlap shear strength and/or its climbing drum peel strength. Standard methods for carrying out these tests are described in MOD Specification DTD 5577 covering adhesives for structural bonding. Using one cold adhesive—Redux 410 (Ciba Geigy) joints were made with L164 clad aluminium alloy sheet adopting precisely the same procedure execepting that one set of test coupons was from aluminium which had been degreased, pickled and given the prior art (40° C.) chromic acid anodise treatment whilst the other set was degreased, pickled, and treated with the new high temperature chromic acid anodising process of this invention as detailed in Example 2 above.

Results

| | | |
|---|---|---|
| 1. | Overlap Shear Strength | |
| | Standard Chromic Acid Anodise | 4,200 lb/in$^2$ |
| | Anodising According To Example 2 | 5,300 lb/in$^2$ |
| 2. | Climbing Drum Peel Strength | |
| | Standard Chromic Acid Anodise | <10 lb/in width |
| | New Chromic Acid Anodising Process | 70 lb/in width |

Further evidence of the difference in adhesion behaviour is given by the modes of failure exhibited by the peel test coupons. All standard anodise coupons failed by a "fast crack" mechanism showing adhesive (from the metal) failure whilst the new process failures were all entirely cohesive (down the middle of joint) in nature.

DURABILITY IN WATER

Wet Debonding

Wedge test (cleavage) specimens given the new high temperature chromic acid anodising treatment on L164 clad alloy and bonded with cold curing Redux 410 survived three month immersion in water at room temperature with no onset of crack growth and no failures. No low solid primer solutions were used as an aid to obtaining this result. Standard chromic acid anodised treated specimens generally failed within hours or days showing symptoms of creep rupture under the high stress imposed by the wedge test.

RESPONSE TO TWO PART SILICONE CASTING AND POTTING COMPOUNDS

A surprising property of the new treatment is the ability to form strong adhesive bonds when contacted by two parts silicone compound such as Silcoset 105 (ICI Plc). A well known and well documented feature of these two part RTV silicones is their intrinsic non-adhesive nature such that they release readily from all contacting surfaces other than their own kind. However, the highly receptive nature of the anodised aluminium surface when treated by the new high temperature chromic acid anodising process, in particular the treatment set out in Example 2, is made evident by the spontaneous formation of strong adhesive bonds whenever these otherwise non-adhesive silicone compounds are cured in contact with this surface. Typically, the cured silicone rubber can only be detached in a complete cohesive failure manner such that remains of the compound are left behind "impregnated" into the surface. This behaviour has not previously been reported for any unprimed treated metal surface.

I claim:

1. A method of preparing an adhesively bonded aluminium or aluminium alloy structure comprising:

forming an environmentally stable adhesive receptive oxide layer on the surfaces of the articles to be adhesively bonded by anodising said articles in a bath containing an aqueous solution of chromic acid, the bath voltage being from at least 5 volts to about 30 volts, the concentration of chromic acid in solution lying in the range of 3% to 5% w/w, said solution being maintained at a temperature between at least 55° C. to about 62° C.; rinsing said articles to remove said solution, applying an adhesive to said surfaces to be adhesively bonded and bonding said articles together to form said adhesively bonded structure.

2. A method according to claim 1 in which the anodic step is carried out for a time and at a voltage such that the resultant anodic layer has a thickness of about 3 microns, and the resultant porosity of the outer, non-barrier layer has a pore diameter of typically 0.2 microns.

3. A method according to claim 1 or claim 2 in which the anodic step is carried out using a step-wise voltage profile in which the bath voltage is maintained at 10 volts for 15 minutes and thereafter 20 volts for a further 15 minutes.

4. A method according to claim 1 or claim 2 in which the anodic step is carried out using a step-wise voltage profile in which the bath voltage is maintained at 10 volts for 10 minutes and thereafter 20 volts for a further 20 minutes.

5. A method of preparing an adhesively bonded aluminium or aluminium alloy structure comprising:

degreasing the articles to be bonded in a solvent vapour tank, forming an environmentally stable adhesive layer on the surfaces of the articles to be adhesively bonded by anodising said articles in a bath containing an aqueous solution of chromic acid in which the free chromic acid concentration is of the order of 35 g/L and total chromic acid 40 g/L, in which the bath temperature is substantially 61° and the bath voltage is maintained at 10 volts for 15 minutes and thereafter 20 volts for a further 15 minutes, rinsing said articles to remove said solution, applying an adhesive to said surfaces to be adhesively bonded and bonding said articles together to form said adhesively bonded structure.

6. A method according to claim 5 in which the resultant anodic layer has a thickness of substantially 3 microns and a porosity of the outer, non-barrier layer has a pore diameter of typically 0.2 microns.

* * * * *